US005225626A

United States Patent [19]

Bowers

[11] Patent Number: 5,225,626

[45] Date of Patent: Jul. 6, 1993

[54] AZIMUTH DETERMINATION METHOD

[75] Inventor: Brian K. Bowers, Bel Air, Md.

[73] Assignee: The United States of America as represented by the Secretary of the Army, Washington, D.C.

[21] Appl. No.: 906,391

[22] Filed: Jun. 30, 1992

[51] Int. Cl.[5] ..... F41G 1/46

[52] U.S. Cl. ..... 89/41.19; 33/234; 33/392; 356/138

[58] Field of Search ..... 33/234, 273, 392; 356/138, 140, 149; 89/41.19

[56] References Cited

U.S. PATENT DOCUMENTS 2,364,055 12/1944 Berry ..... 33/392

4,709,614 12/1987 Klumpp ..... 89/1.35

FOREIGN PATENT DOCUMENTS 17089 8/1905 United Kingdom ..... 33/234

OTHER PUBLICATIONS

Manucy, Albert, Artillery Through the Ages, 1949, pp. 75–77.

*Primary Examiner*—Stephen C. Bentley

*Attorney, Agent, or Firm*—Anthony T. Lane; Edward Goldberg; Michael C. Sachs

[57] ABSTRACT

A method for measuring the azimuth angles of grenade launcher tubes quickly and directly, uses an easily fabricated, portable fixture and a commercially available hand-held electronic compass. There is not need for a precise set-up of complex equipment or mathematical computations.

8 Claims, 1 Drawing Sheet

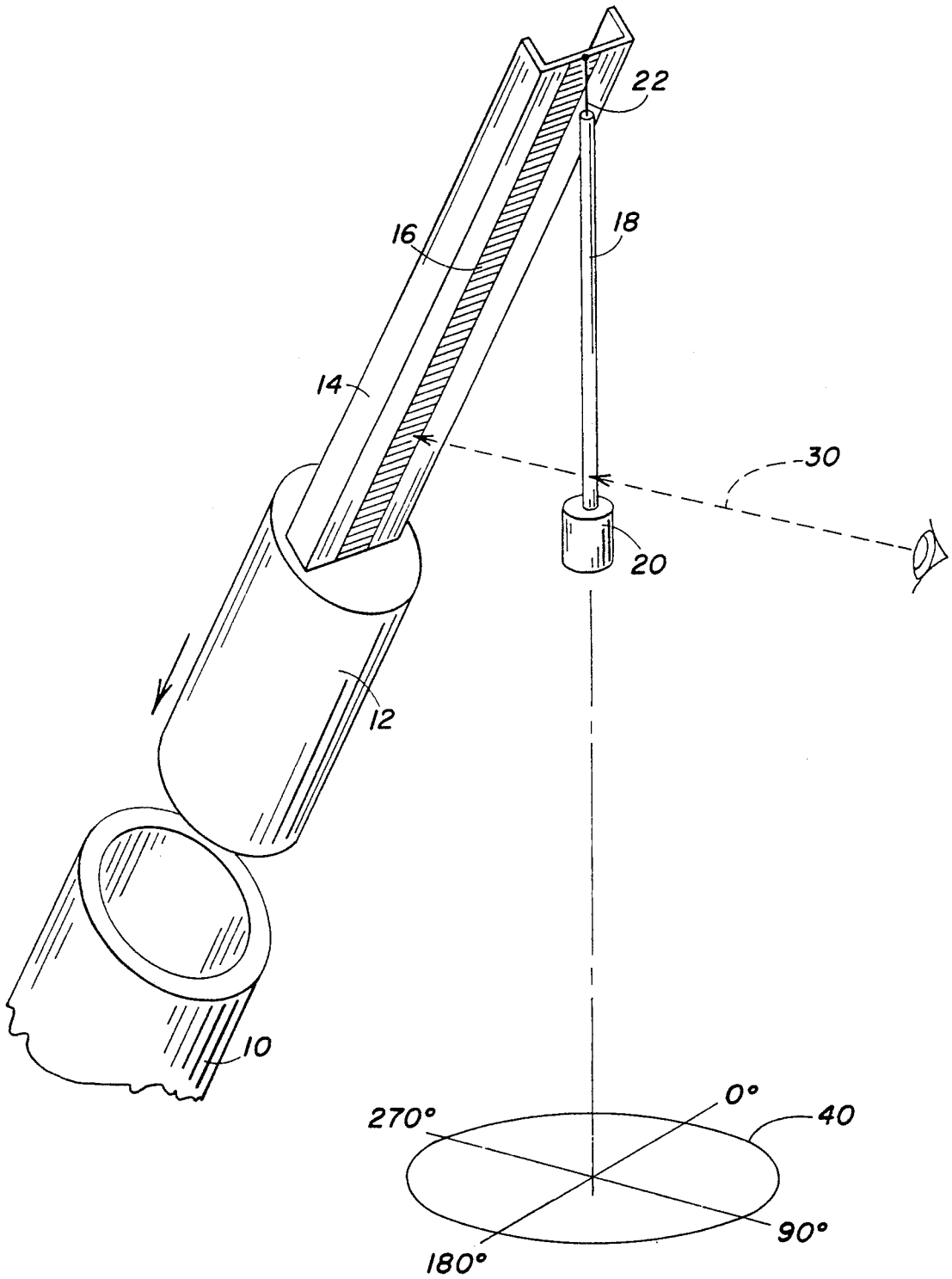
22
18
16
14
30
20
12
10
0°
270°
40
90°
180°

AZIMUTH DETERMINATION METHOD

STATEMENT OF GOVERNMENT INTEREST

The invention described herein may be made, used or licensed by or for the Government for Government purposes without the payment of any royalty to me.

FIELD AND BACKGROUND OF THE INVENTION

Currently practiced methods of measuring the azimuth angle of smoke grenade launcher tubes mounted on vehicles or test fixtures are unsatisfactory. They require the precise set-up and use of complicated surveying equipment and complex mathematical computations. These methods are slow, tedious, and of questionable accuracy, given the assumptions that are made relative to the geometry of the problem, and the accumulated errors in measurement.

A need remains for a simple technique for taking the horizontal azimuth angle of a launcher tube using inexpensive and easily manipulated equipment.

SUMMARY OF THE INVENTION

The method of the present invention allows an azimuth angle to be measured quickly and directly with an inexpensively fabricated fixture and a commercially available compass, for example, an electronic compass.

Accordingly, an object of the present invention is to provide a method of determining the azimuth of a grenade launcher tube having a centerline which is elevated at an elevation angle, comprising: extending a straight line marker parallel to the centerline, the marker having an outer end spaced from the tube; hanging an elongated plumb bob vertically from the end of the marker; sighting along a substantially horizontal line of sight which lies in a plane containing the plumb bob and the marker; and reading a horizontal bearing of the line of sight which corresponds to the azimuth of the tube.

A further object of the present invention is to provide an inexpensive fixture for use in practicing the inventive method.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

The only drawing in the application is a perspective view of a fixture used to practice the present invention.

DESCRIPTION OF THE PREFERRED EMBODIMENT

Referring to the drawing in particular, the invention embodied therein comprises a fixture for use in quickly, inexpensively and accurately determining the azimuth of a smoke grenade launcher tube 10, that is the substantially horizontal angle around an azimuth schematically illustrated at 40, on which a grenade launched from the tube will travel in its parabolic flight from the tube.

The fixture comprises a plug 12 of metal, plastic or wood, which is shaped and dimensioned to closely fit within the bore of the launcher tube 10. The size and shape of plug 12 should be such that the fixture can easily be inserted and removed from the tube but further so that an extension 14 having a flat surface containing a straight line marker 16, lies parallel to the centerline of the tube. Extension 14 is advantageously an inexpensive U-shaped channel of metal or plastic. Marker 16 can simply be painted, adhered or otherwise defined on the flat web of the channel 14.

A wire or other freely moveable connector 22 is attached to the free outer end of channel 14, at the outer end of marker 16. An elongated plumb bob 18, 20 extends downwardly from wire 22 and hangs vertically under the force of gravity. The plumb bob comprises an elongated rod 18 having a weight 20 connected at its lower free end. Any other elongated member with weight can be used.

In order to use the fixture of the present invention, one walks around an arc on the azimuth 40, until a line of sight 30 is visually aligned with the elongated plump bob rod 18 lying over and parallel to the line marker 16. For this purpose, contrasting colors should be used between the elongated plumb bob and marker. With sighting along line 30, marker 16, rod 18 and line of sight 30 form a triangular shape which lies in the plane that also contains the parabolic flight path for the grenade to be launched from the tube 10. Using any commercially available compass device, for example, an electronic compass, the bearing of substantially horizontal line of sight 30 is taken. This provides a measurement which corresponds precisely to the horizontal azimuth for the tube 10. As a practical matter since sighting is taking place in an opposite direction to the actual flight path of the grenade, 180° should be added to whatever angular bearing is given by the compass, to give the actual azimuth for the launcher tube. Although the line of sight 30 and the azimuth arc 40 should be substantially horizontal, this encompasses inclines necessitated by terrain on which the tube or it vehicle, are mounted.

The present invention thus provides a versatile, extremely simple, effective and accurate method of measuring azimuth using inexpensive equipment and a commercially available compass. By walking on an arc of about 20 to 30 paces around the tube, the line of sight 30 can be taken with minimum difficultly.

While a specific embodiment of the invention has been shown and described in detail to illustrate the application of the principles of the invention, it will be understood that the invention may be embodied otherwise without departing from such principles.

What is claimed is:

1. A method of determining the azimuth of a grenade launcher tube having a centerline elevated at an elevation angle, comprising:

extending a straight line marker parallel to the centerline, the marker having an outer end spaced from the tube;

hanging an elongated plumb bob vertically from the end of the marker;

sighting along a substantially horizontal line of sight which lies in plane containing the plumb bob and the marker; and reading a horizontal bearing of the line of sight which corresponds to the azimuth of the tube.

2. A method according to claim 1, including attaching the straight line marker to an extension, attaching the extension to a plug, and inserting the plug into the tube before sighting along the line of sight.

3. A method according to claim 2, wherein the plumb bob comprises an elongated rod having one end flexible connected to the end of the marker, and an opposite lower end, and a plumb bob weight connected to the opposite lower end of the rod.

4. A method according to claim 3, including adding 180° to the horizontal bearing to give the azimuth of the tube.

5. An apparatus for determining the azimuth of a grenade launcher tube having centerline elevated to an elevation angle, comprising:

a plug for insertion into the launcher tube;

an extension extending substantially parallel to the centerline and outwardly from the plug;

a straight line marker on the extension lying parallel to the centerline when the plug is in the tube; and an elongated plumb bob flexible connected to an outer end of the marker and being elongated for lying in a plane containing a line of sight at a horizontal bearing corresponding to the azimuth, containing the elongated plumb bob and containing the marker.

6. An apparatus according to claim 5, wherein the plug is cylindrical and the extension is channel shaped and has a web, the marker defined on the web.

7. An apparatus according to claim 6, including a flexible wire connected between the channel and the plumb bob.

8. An apparatus according to claim 7, wherein the plumb bob comprises an elongated rod connected to the wire and a weight connected to the rod.

* * * * *